US010577779B2

(12) United States Patent
Hoeptner, III

(10) Patent No.: US 10,577,779 B2
(45) Date of Patent: Mar. 3, 2020

(54) SELF-DRAINING HYDRANT WITH PISTON ASSEMBLY

(71) Applicant: Herbert W. Hoeptner, III, Gilroy, CA (US)

(72) Inventor: Herbert W. Hoeptner, III, Gilroy, CA (US)

( * ) Notice: Subject to any disclaimer, the term of this patent is extended or adjusted under 35 U.S.C. 154(b) by 1 day.

(21) Appl. No.: 15/938,099

(22) Filed: Mar. 28, 2018

(65) Prior Publication Data

US 2018/0282982 A1 Oct. 4, 2018

Related U.S. Application Data

(60) Provisional application No. 62/601,679, filed on Mar. 28, 2017.

(51) Int. Cl.

| | |
|---|---|
| ***E03B 9/14*** | (2006.01) |
| ***E03B 9/04*** | (2006.01) |
| ***E03B 7/12*** | (2006.01) |

(52) U.S. Cl.

CPC ..... *E03B 9/14* (2013.01); *E03B 7/12* (2013.01); *E03B 9/04* (2013.01); *Y10T 137/538* (2015.04)

(58) Field of Classification Search

CPC ..... E03B 9/14; E03B 9/04; E03B 7/12; Y10T 137/538

See application file for complete search history.

(56) References Cited

U.S. PATENT DOCUMENTS

| | | | | |
|---|---|---|---|---|
| 4,854,339 | A | 8/1989 | Hoeptner, III | |
| 5,033,500 | A | 7/1991 | Hoeptner, III | |
| 5,553,637 | A | 9/1996 | Hoeptner, III | |
| 6,047,723 | A | 4/2000 | Hoeptner, III | |
| 6,085,776 | A | 7/2000 | Hoeptner, III | |
| 6,427,716 | B1 | 8/2002 | Hoeptner, III | |
| 6,857,446 | B1 | 2/2005 | Hoeptner, III | |
| 2006/0008362 | A1 * | 1/2006 | Hugelman | F04B 1/128 417/269 |

* cited by examiner

*Primary Examiner* — Mary E McManmon
*Assistant Examiner* — Kevin R Barss
(74) *Attorney, Agent, or Firm* — Intellectual Innovations Legal Advisors

(57) ABSTRACT

A self-draining hydrant comprising a supply line coupled to an outlet and a housing adapted for placement in the ground and for coupling to a water supply. The housing can selectively provide water from the water supply to the supply line and has a reservoir for receiving drained water from the supply line. A piston is movable in a direction of travel from a first position to a second position within the housing for engaging the drained water and expelling it from the reservoir. The piston has a seal for engaging the housing to provide a seal with respect to the drained water. The housing has at least one slot extending in the direction of travel and engageable by the seal for permitting drained water to pass the seal.

18 Claims, 6 Drawing Sheets

SELF-DRAINING HYDRANT WITH PISTON ASSEMBLY

CROSS REFERENCE TO RELATED APPLICATION

This application claims priority to U.S. provisional patent application Ser. No. 62/601,679 filed Mar. 28, 2017, the entire content of which is incorporated herein by this reference.

FIELD OF THE INVENTION

This invention relates generally to self-draining hydrants, and more particularly to self-draining hydrants with piston assemblies.

BACKGROUND OF THE INVENTION

Self-draining hydrants have been provided. See for example U.S. Pat. Nos. 6,047,723 and 6,427,716. There is a need, however, for a self-draining hydrant with a piston assembly having improved sealing.

DETAILED DESCRIPTION OF THE INVENTION

Figure 1:
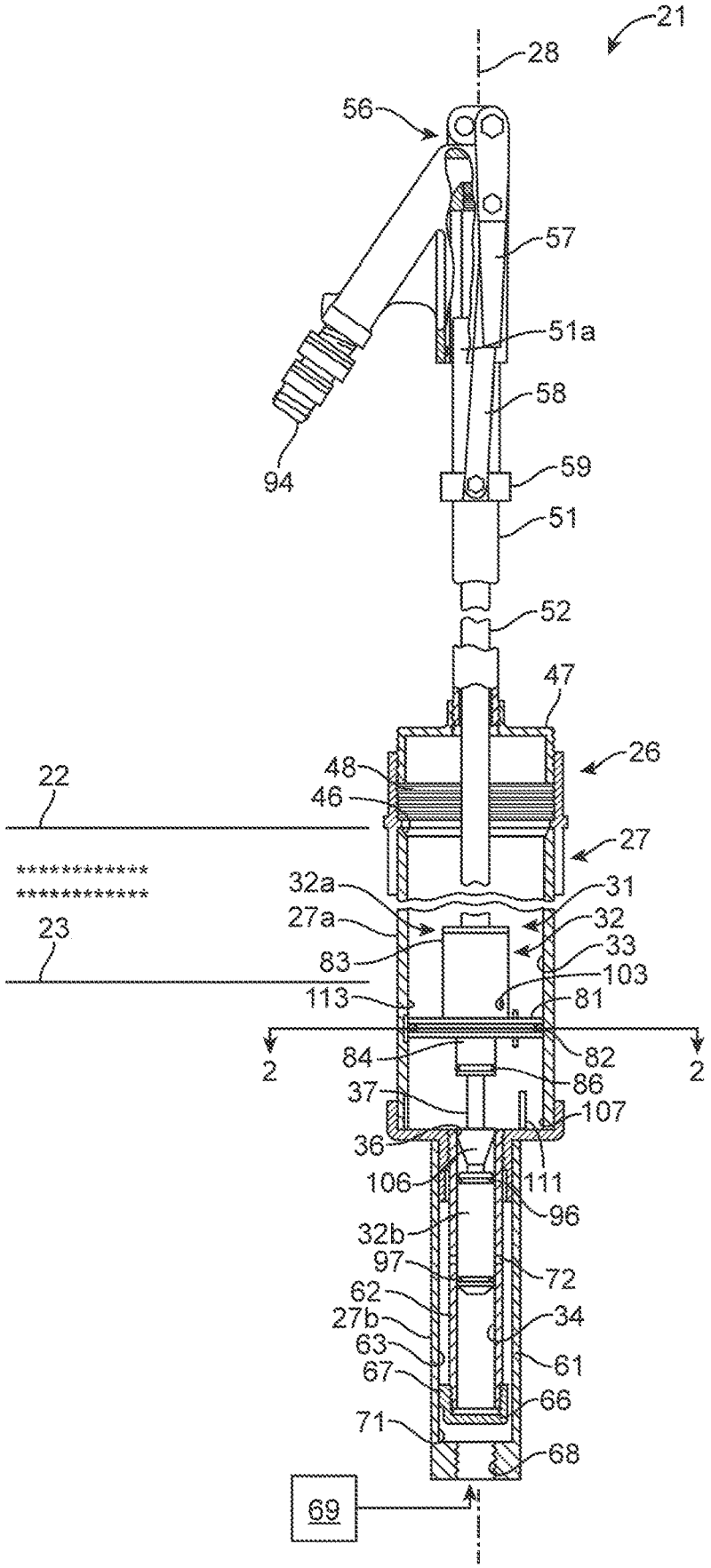
FIG. 1 is an isometric view, partially cut away at portions, of self-draining hydrant of the invention in an OFF configuration.

A self-draining hydrant is provided that can be installed underground, for example in areas where the above ground atmosphere can experience freezing temperatures. The self-draining hydrant can be of any suitable type, for example provided with a supply line for providing liquid to a head or other outlet provided with an opening. The self-draining hydrant can be manually operable, for example by use of a handle that can be gripped by a user. The self-draining hydrant can be provided with a reservoir for draining the supply line when the self-draining hydrant is in an OFF position or configuration. The self-draining hydrant can include a drain assembly having a piston, movable between first and second positions, for emptying or draining the accumulated liquid in the reservoir, for example when the self-draining hydrant is activated. The piston can be moved to empty or drain the accumulated liquid in the reservoir under the force provided by the user to the handle.

A self-draining hydrant 21 can be provided for use in areas that encounter freezing temperatures. The hydrant 21 can include at least a portion which is provided below ground level 22, and at least a portion of the below-ground portion being below the frost line 23. In some embodiments, the hydrant 21 includes a housing 26 of any suitable type, for example having a main body 27 that can be disposed below ground level 22. The main body 27 can be of any suitable type and include a first or upper housing portion 27*a* and a second or lower housing portion 27*b*. Each housing portion 27*a*, 27*b* can be of any suitable shape, for example cylindrical in shape and tubular in configuration. In some embodiments, first housing portion 27*a* has a transverse dimension or diameter that is larger than the transverse dimension or diameter of second housing portion 27*b*. Each of first housing portion 27*a* and second housing portion 27*b* can be referred to as a cylinder. The main body 27 can extend vertically along a longitudinal or vertical axis 28.

Figure 3:
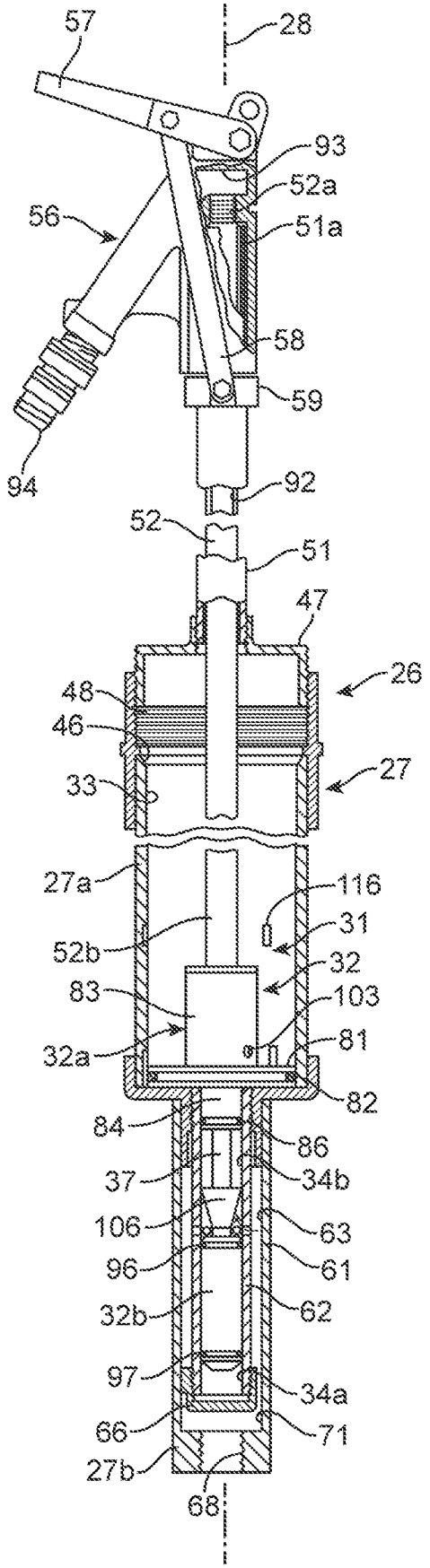
FIG. 3 is an isometric view, partially cut away at portions, of the self-draining hydrant of FIG. 1 in an ON configuration.

The hydrant 21 can include a drain assembly 31 of any suitable type, for example disposed within housing 26. The drain assembly can include a piston 32 movable between first and second positions within the housing 26, for example movable along the longitudinal axis 28 between a first or upper position, for example as shown in FIG. 1, and a second or lower position, for example as shown in FIG. 3. The piston 32 can include a first or upper head 32*a* and a second or lower head 32*b*. The upper head 32*a* can be movably disposed within first or upper housing portion 27*a*, for example within a first or upper chamber 33 within housing portion 27*a*, and the lower head 32*b* can be movably disposed within second or lower housing portion 27*b*, for example within a second or lower chamber 34 within housing portion 27*b*. In some embodiments, upper head 32*a* has a transverse dimension or diameter that is larger than the transverse dimension or diameter of lower head 32*b*. In some embodiments, upper chamber 33 has a transverse dimension or diameter that is larger than the transverse dimension or diameter of lower chamber 34. The lower chamber 34 can communicate with the upper chamber 33 at an opening 36, which can be located at the top end of the lower chamber 34. In some embodiments, upper head 32*a* is separated from lower head 32*b* and heads 32*a*, 32*b* are joined together by a suitable elongate element or member 33, such as a pipe or tube 37.

Main body 27 can have an opening 46 at its top end for communicating with the upper chamber 33 of the body 27. The opening 46 can be sufficiently sized so as to permit piston 32 to be loaded into main body 27 and removed from the main body 27 through the opening 46. Housing 26 can include an upper end portion 47, which can be referred to as a cap 47, that can be removably attached to the main body 27, for example over opening 46. A sealed 48 of any suitable type, for example an annular seal 48, can be provided for providing a sealing engagement between 47 and main body 27. An outer tubular member or element 51, which can be referred to as a tube, pipe, dry tube or pipe or outer tube or pipe, can be rigidly secured to cap 47 by any suitable means and extend upwardly from the housing 26, for example along or parallel to longitudinal axis 28. Dry tube 28 can terminate at an upper end 51*a*. An inner tubular member or element 52, which can be referred to as a tube, pipe, wet tube or pipe, inner tube or pipe or supply line, can be slidably disposed within dry tube 51. The dry tube 52 can have a first or upper end 52*a* accessible at the upper and 51*a* of the dry tube 51 and a second or lower end 52*b* coupled or rigidly joined to piston 32, for example upper head 32*a* of the piston 32.

An outlet 56 of any suitable type can be slidably disposed on upper end 51*a* of the dry tube 51 between a first or upper position, for example as shown in FIG. 1, and a second or lower position, for example as shown in FIG. 3. In some embodiments, the outlet is a head 56. The head or other outlet 56 can be rigidly coupled or joined to upper end 52*a* of the wet tube 52. For example, the upper end 52*a* can be threaded and, as such, threaded into a cooperatively-formed threaded recess or socket provided in the head 56 for providing a fluid-tight seal between the head 56 in the wet tube 52. An actuation element 57 of any suitable type can be carried by upper end 51*a* of the dry tube 51 for causing the head 56 to move between its first and second positions. In some embodiments, the actuation element is a handle 57 pivotably coupled to the head in any suitable manner. A suitable elongate element or link 58 is pivotally coupled at one end to the actuation element or handle 57 and is pivotably coupled at its other end to the upper end 51*a* of the dry tube 51, for example to a collar 59 rigidly secured to the upper end 51*a* of the dry tube. Pivoting of the handle 57, for example under the force of a user of hydrant 21, from a first position to a second position causes the head 56 to move between its first position to its second position. In some embodiments, handle 57 has a first position, for example as shown in FIG. 1, in which the handle is in a recessed position with respect to the head 56 and dry tube 51, and a second position, for example as shown in FIG. 3, in which the handle has been pivoted through an angle relative to the head 56, for example through an angle of approximately 90°. The pivoting of the handle from its first position to its second position thus causes piston 32 to move between its first position to its second position.

Second housing portion 27 be can be formed from an outer tubular element or member 61, which can be referred to as an outer tube or cylinder 61, and an inner tubular element or member 62, which can be referred to as an inner tube or cylinder 62. The inner tubular member 62 can form lower chamber 34, which opens into upper chamber 33 at opening 36 provided at the top end of the inner tubular member. The inner tubular member can be spaced inwardly of the outer tubular member so that an annular passageway 63 is provided between the members or cylinders 61, 62. The inner tubular member is joined to the outer tubular member by any suitable means, for example so as to provide a fluid tight seal between the top end of the inner tubular member 62 and the top end of the outer tubular member 61 and thus seal or close annular passageway 63 at the top end of the tubular members 61, 62. The bottom end of the inner tubular member 61 can be sealed, for example so as to preclude liquid from entering or exiting lower chamber 34 at the bottom of the inner tubular member, and joined to the bottom portion of the outer tubular member 62 in a manner that permits liquid to enter the bottom of annular passageway 63. In some embodiments, a cap 66 is joined to the bottom end of inner tubular member 62 for sealing lower chamber 34 and provided with a plurality of radially-extending protuberances 67 for engaging and joining the cap 66 to the bottom portion of outer tubular member 61. The lower end of the outer tubular member 61 can be provided with an opening 68, for example a threaded opening 68, for permitting connection to a suitable water supply 69 of any suitable type. The inner tubular member 62 is shorter than the outer tubular member 61 so that an entry chamber 71 is provided below the inner tubular member and in communication with the entry opening 68. The radially-extending protuberances 67, only one of which is shown in the drawings, permit supply water to pass from entry chamber 71 into the bottom of annular passageway 63. The inner tubular member 62 can be provided with a plurality of circumferentially spaced-apart openings or holes 72 extending through the tubular member 62 to permit supply water to pass from annular passageway 63 into lower chamber 34. The openings or holes 72, which can be referred to as ports 72, can be disposed in a plane, for example a plane extending perpendicular to the longitudinal axis 28 of hydrant 21.

Upper head 32*a* of piston 32 can include a central cylindrical portion or disk 81 for engaging the inner surface of upper chamber 33 so as to permit the upward and downward movement of the piston 32 within the upper chamber 33. Central portion 81 can include an annular seal 82 of any suitable type extending around its outer cylindrical periphery for providing a fluid-tight seal between the portion 81 and the inner surface of upper chamber 33. An upper cylindrical portion 83 can be joined to and extend upwardly from central portion 81, for example centered on longitudinal axis 28, and have an outer diameter or transverse dimension less than the outer diameter or transverse dimension of central portion 81 of the piston upper head 32*a*. A lower cylindrical portion 84 can be joined to and extend downwardly from central portion 81, for example centered on longitudinal axis 28, and have an outer diameter or transverse dimension less than the outer diameter or transverse dimension of central portion 81. The bottom end of lower cylindrical portion 84 can include an annular seal 86 of any suitable type extending around its outer cylindrical periphery. Lower cylindrical portion 84 can be radially sized to slidably fit within lower chamber 34 of inner tubular member 62. Annular seal 86 can serve to form a fluid-tight seal between the lower cylindrical portion 84 and the inner circular surface of inner tubular member 62.

Figure 4:
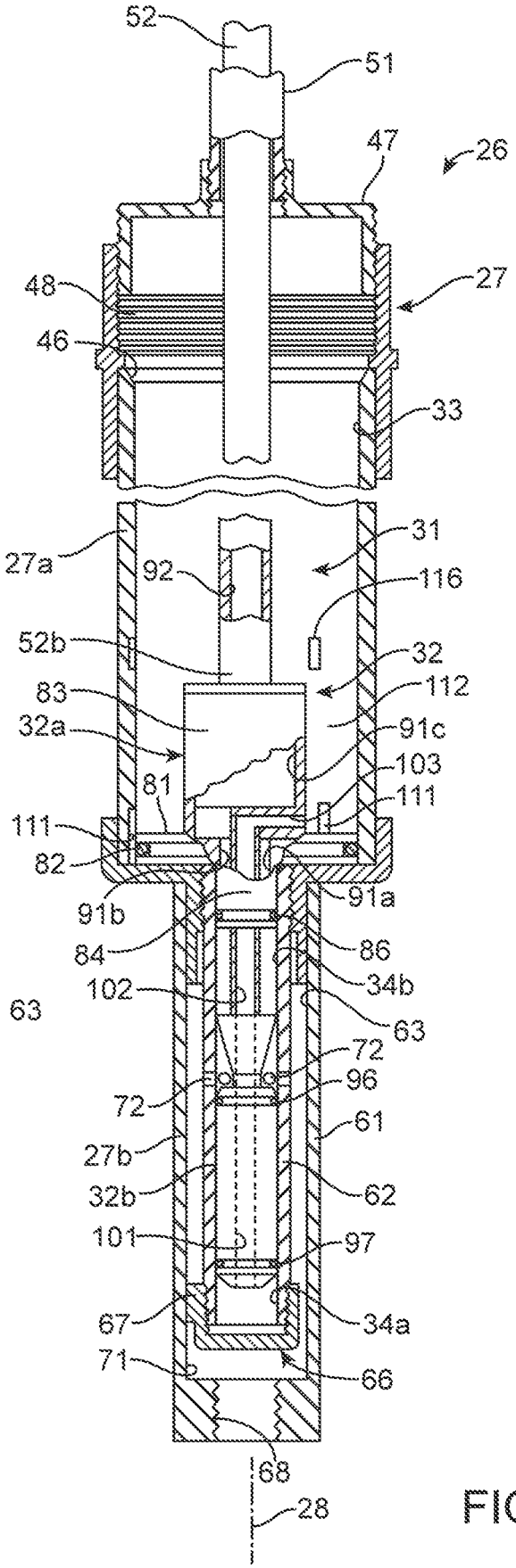
FIG. 4 is an enlarged view, partially cut away, of a portion of the self-draining hydrant of FIG. 1 in its ON configuration of FIG. 2.

Piston upper head 32*a* can be provided with a passageway 91 extending longitudinally or vertically therethrough and communicating with the internal bore or passageway 92 of wet tube 52 (see FIG. 4). The passageway 91, which can be centered on longitudinal axis 28, can include a lower portion 91*a*, which for example can be annular in shape and formed between the outer cylindrical wall of lower portion 84 and tube 37 and provided within annular opening (not shown) provided at the bottom of the lower portion 84. The passageway 91 can further include a central portion 91*b* extending through central portion 81 of piston upper head 32*a* and an upper portion 91*c* extending through upper portion 83 of the piston upper head 32*a* so as to communicate with passageway 92 of the wet tube 52. Passageway 92 at upper end 52*a* of the wet tube 52 communicates with a chamber or passageway 93 provided in head 56. The head passageway 93 communicates with an opening 94, which serves to discharge supply water from the head 56 and hydrant 21.

Lower piston head 32*b* can be cylindrical in conformation and radially sized to slidably fit within lower chamber 34 of inner tubular member 62. The lower piston head can be referred to as a cylinder. The upper end of lower piston head 32*b* can include a first or upper annular seal 96 of any suitable type extending around its outer cylindrical periphery, and the lower end of lower piston head 32*b* can include a second or lower annular seal 97 of any suitable type extending around its outer cylindrical periphery. Lower piston head 32*b* includes the longitudinal bore or passageway 101 extending the length of the head 32*b*, for example along longitudinal axis 28, and communicating with a bore or passageway 102 extending through tube 37 (see FIG. 4).

The tube 37, and passageway 102 therethrough, extend through lower cylindrical portion 84 and central cylindrical portion 81 of upper piston head 32*a* and communicate with a side port 103 extending radially outwardly through upper cylindrical portion 83 of the upper piston head to an opening into upper chamber 33. The lower end of passageway 101 extending through lower piston head 32*b* communicates with the portion 34*a* of lower chamber 34 provided between the lower face, surface or end of the lower piston head 32*b* and cap 66 that forms the end of inner tubular member 62 (see FIG. 3).

When the annular seal 86 of lower cylindrical portion 84 of the upper piston head 32*a* is disposed in lower chamber 34 of second housing portion 27*b*, the portion of the chamber 34 between the upper piston and 32*a* and the lower piston head 32*b* can be referred to as the annular portion 34*b* of the lower chamber 34 (see FIG. 3). Tube 37 extends through the chamber annular portion 34*b* between upper piston head 32*a* and lower piston head 32*b*. A check valve 106 of any suitable type, for example a cone-shaped rubber check valve, is provided around tube 37 between the upper head 32*a* of piston 32 and the lower head 32*b* of the piston. The check valve 106 permits upward flow of supply water past the valve 106 within annular portion 34*b* of the lower chamber 34, but precludes the downward flow of any liquid past the check valve within the annular portion 34*b* of the lower chamber.

In some methods of operation, self-draining hydrant 21 is installed in the ground in any suitable manner. In some methods of insulation, at least central cylindrical portion 81 of upper piston head 32*a* is below the frost line 23 at all times as the piston 32 to moves upwardly and downwardly between its first and second positions. The hydrant 21 is coupled to water supply 69 in any suitable manner, for example a line from the supply 69 is joined to opening 68 at the bottom of second housing portion 27*b* so that pressurized supply water is provided through the opening 68 into entry chamber 71 and annular passageway 63.

An operator can activate the hydrant 21, that is positioned in an OFF configuration or position when at rest, by gripping handle 57 and pivoting the handle from its first position shown in FIG. 1 to its second position shown in FIG. 3. Lifting and so pivoting the handle 57 causes link 58, which is attached to collar 59 solidly mounted on dry pipe 51, to slide head 56 downwardly on upper end 51*a* of dry tube 51. The downwardly moving head 56 causes wet tube 52 to simultaneously move downwardly and thus cause piston 32 to simultaneously move downwardly from its first position to a second position. The downward movement of piston 32 is limited by central cylindrical portion 81 of the piston engaging the bottom surface of upper chamber 33. As the piston 32 moves downwardly, lower cylindrical portion 84 of the upper piston head 32*a* enters opening 36 of lower chamber 34. In this regard, annular seal 86 provided at the bottom of lower cylindrical portion 84 provides a fluid-tight seal between the lower piston portion 84 and the inner tubular member 62 once the seal 86 engages the inner circular surface of lower chamber 34. When the piston 32 is in its second or lower position, annular portion 34*b* of the lower chamber 34 is in registration with openings or ports 72 provided in the inner tubular member 62 to permit pressurized water from annular chamber 63 to enter annular portion 34*b* of chamber 34. The pressurized water in annular portion 34*b* flows upwardly past check valve 106 into passageway 91 extending through upper piston head 32*a* and then through passageway 92 of wet tube 52, through passageway 93 of head 56 and out opening 94 in the head. Upper and lower seals 96, 97 provided on lower piston head 32*b* preclude the pressurized water from traveling downwardly in chamber 34 past the lower piston head into lower portion 34*a* of the chamber 34.

Hydrant 21 can be turned OFF by the user gripping handle 57 and pivoting the handle from its second position of FIG. 3 to its first position of FIG. 1 so as to cause piston 32 to move upwardly from its second position of FIG. 3 to its first position of FIG. 1. When in its second position, the lower piston head 32*b* registers with ports 72 so as to cease the flow of pressurized water into lower chamber 34. More specifically in this regard, the portion of the lower piston head 32*b* between upper seal 96 and lower seal 96 of the lower piston is in registration with ports 72 so that pressurized water cannot flow upwardly past upper seal 96 within chamber 34 or downwardly past lower seal 97 into lower portion 34*a* of the lower chamber. When the piston 32 is in its upper position, check valve 106 is in registration with opening 26 of lower chamber 34 so as to preclude any water within upper chamber 33 from entering the lower chamber 34 (see FIG. 1). The portion of the upper chamber 33 between the annular seal 82 around the periphery of central cylindrical portion 81 of the upper piston head and check valve 106 can be referred to as a reservoir 107. When piston 32 is in its first position and supply water is blocked by lower piston and 32*b*, the remaining water in wet pipe 52 drains downwardly out of the wet pipe into reservoir 107. The accumulated or drained water in reservoir 107 will not freeze because it is below frost line 23 in the earth.

Reactivation of the hydrant 21 causes the accumulated water within reservoir 107 to be expelled from the hydrant. In this regard, the downward movement of piston 32 from its first position to its second position causes central cylindrical portion 81 of the upper piston head 32*a* to reduce the volume of reservoir 107 and expel the accumulated water in the reservoir up through passageway 91 of upper piston head 32*a* and into passageway 92 of wet tube or pipe 52. Similarly, the downwardly moving lower piston and 32*b* reduces the volume of lower portion 34*a* of lower chamber 34 and causes any water therein to be expelled upwardly through passageway 101 in the lower piston head 32*b*, through passageway 102 in tube 37 and out side port 103 into upper chamber 34.

Figure 5D:
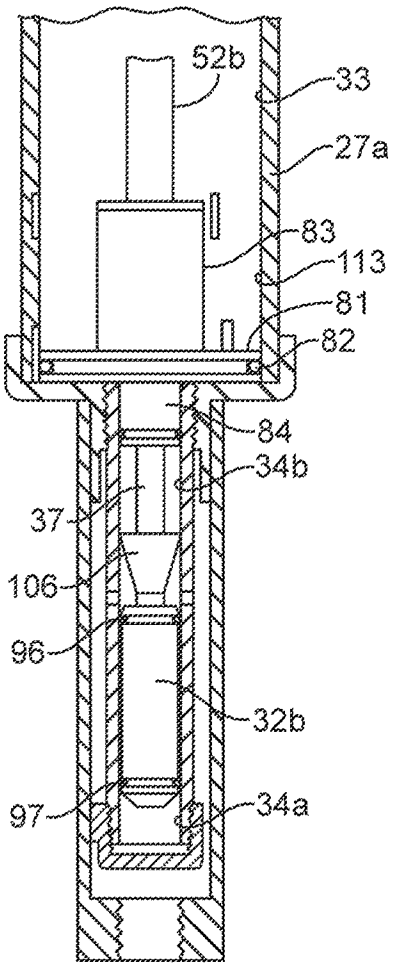
FIG. 5D is the self-draining hydrant of FIG. 1 in a fourth configuration of a half stroke.
Figure 5C:
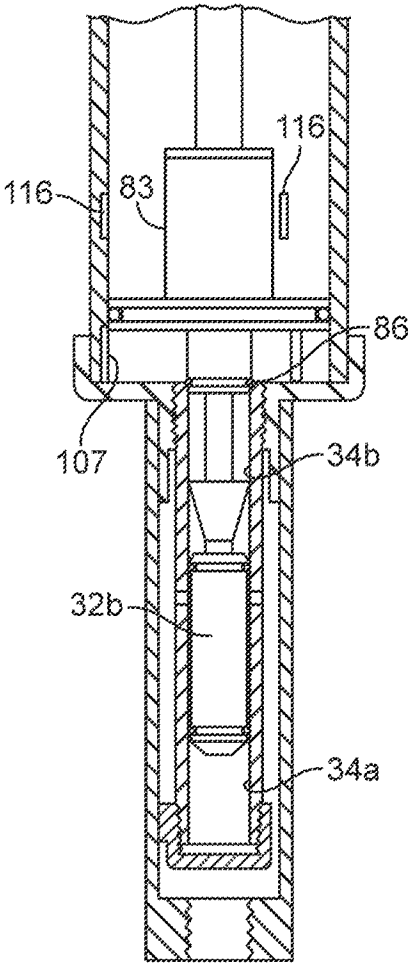
FIG. 5C is the self-draining hydrant of FIG. 1 in a third configuration of a half stroke.
Figure 5B:
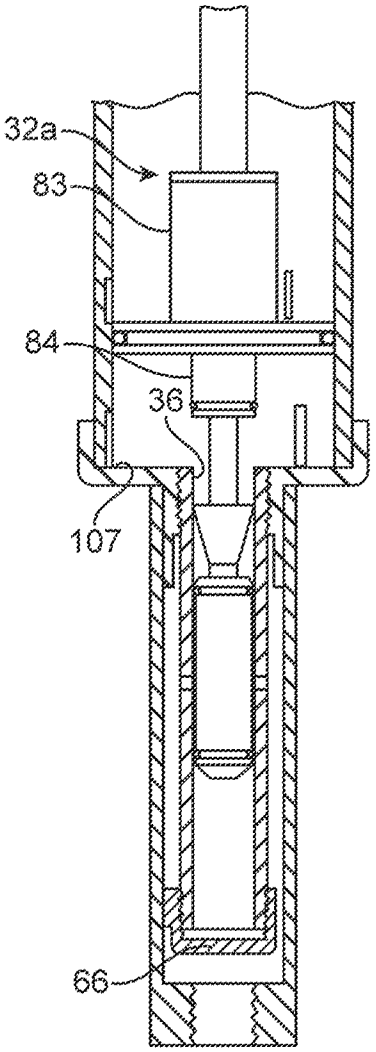
FIG. 5B is the self-draining hydrant of FIG. 1 in a second configuration of a half stroke.
Figure 5A:
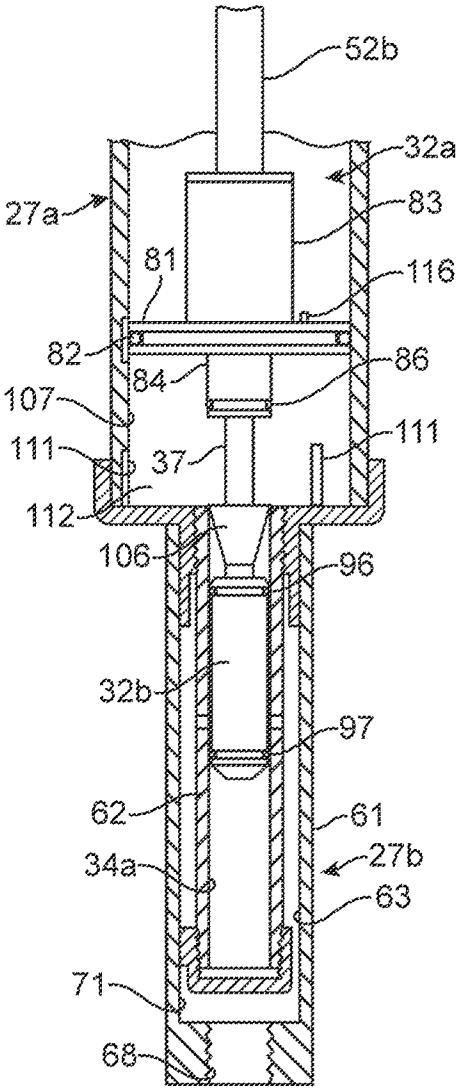
FIG. 5A is the self-draining hydrant of FIG. 1 in a first configuration of a half stroke.
Figure 6:
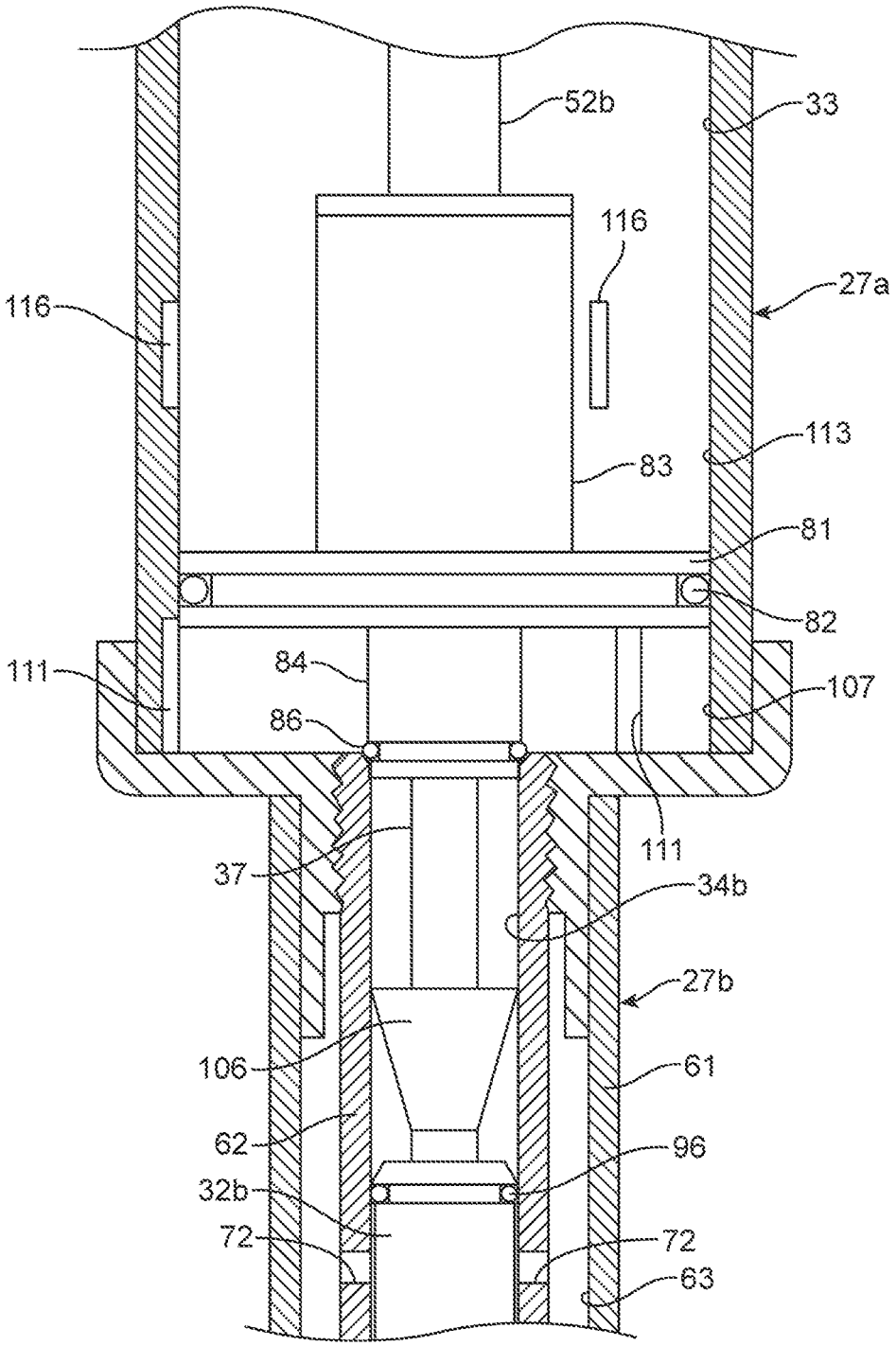
FIG. 6 is an enlarged view of a portion of the self-draining hydrant of FIG. 1 in the third configuration of FIG. 5C.

FIG. 5 illustrates piston 32 in various positions of a half stroke starting with the piston in its first position in FIG. 5A and ending with the piston in its second position in FIG. 5D. In FIG. 5B, the piston 32 has moved partially downwardly from its first position. In FIG. 5C, the piston 32 has moved further downwardly to a position where annular seal 86 at the bottom of lower cylindrical portion 84 of the upper piston head 32*a* has engaged opening 36 at the top of lower chamber 34. Once annular seal 86 has engaged lower chamber 34 at opening 36, the opening at the bottom of lower cylindrical portion 84 to passageway 91 extending upwardly through upper piston and 32*a* is closed or sealed, thus precluding the remaining water within reservoir 107 from escaping through passageway 91 and out passageway 92 of wet tube 52 to opening 94 in head 56. Once reservoir 107 is sealed at its bottom by annular seal 86 and at its top by annular seal 82, the reservoir 107 can be referred to as a sealed reservoir, thus precluding any water within the sealed reservoir from escaping or exiting the sealed reservoir. The sealing of reservoir 107 can cause a hydraulic lock to occur within self-draining hydrant 21, which can inhibit if not preclude further movement of the piston 32 against the pressure or force within the sealed reservoir.

Self-draining hydrant 21 can include one or more grooves or slots provided in a wall forming a chamber in which a piston of the hydrant 21 travels for permitting a fluid to pass a moving seal of the piston. The moving seal can optionally be an annular seal, for example annular seal 82 around the periphery of central cylindrical portion 81 of the upper piston head 32*a*. In some embodiments, the one or more grooves or slots can inhibit hydraulic lock of the piston and the drain assembly of the invention. In some embodiments, the one or more grooves or slots extend along the distance of travel of the piston, for example vertically within the chamber in which the piston vertically travels. The one or more slots can be equal in length or vary in length. In some embodiments, at least a portion of the one or more slots engage the moving seal once the chamber or reservoir being compressed by the piston is a sealed reservoir or otherwise sealed. In some embodiments, the one or more slots are provided in an inner surface of the wall forming the chamber. The one or more slots can be circumferentially spaced apart around the chamber. The one or more slots can be vertically staggered around the circumference of chamber, and be of equal or differing lengths. The one or more slots can be fully contained in the internal wall, that is out of communication with the exterior of the housing. The internal wall can have a thickness and the one or more slots can each have a thickness less than the thickness of the internal wall. The one or more slots can occupy a small circumferential fraction of the wall of the chamber, for example less than 10% of the circumference of the chamber, or occupy a larger portion of the chamber. The one or more slots provide a sufficient remaining portion of the chamber wall to guide the piston, and any annular seal carried thereby, throughout the length of travel of the piston. For example, the one or more slots provide a sufficient remaining portion of the chamber wall to preclude radial drift of the piston, for example radial drift relative to longitudinal axis 28 of hydrant 21, throughout the vertical travel of the piston. For example, a sufficient circumferentially spaced-apart portion of the chamber wall is provided to preclude radial drift to the piston.

In some embodiments, one or more slots or grooves 111 are provided in inner wall 112, for example the inner surface of the inner wall 112, of first housing portion 27*a* forming upper chamber 33. The inner or internal wall 112 can be a cylindrical wall 112. The one or more slots or grooves 111 extend vertically along a portion of the length of the chamber 33 and are circumferentially spaced-apart around the chamber 33. In some embodiments, the one or more slots or grooves 111 each have a length so that annular seal 82 on central cylindrical portion 81 of upper piston head 32*a* engages at least a portion of each of the one or more slots or grooves 111 once reservoir 107 becomes a sealed reservoir. In some embodiment, the length of each of the one or more slots or grooves 111 approximates or equals the distance between annular seal 86 on lower cylindrical portion 84 to the lower surface of central cylindrical portion 81. In some embodiments, the annular seal 86 has a thickness and each of the one or more slots has a length greater than the thickness of the seal 86. In some embodiments, when annular seal 86 makes contact with opening 36 of lower chamber 34 the annular seal 82 should make contact with the top of the one or more slots or grooves 111, thus for example preventing a hydraulic lock. The one or more slots or groves 111 permit the trapped water within sealed reservoir 107 to pass by the annular seal 82 and escape the reservoir and pass into the portion of chamber 33 above central cylindrical portion 81, which can be referred to as an upper or additional reservoir 113 in chamber 33. In some embodiments, more slots or grooves 111 can serve to move water faster from lower reservoir 107 to upper reservoir 113 and contribute to smooth movement of handle 57 during the operation of hydrant 21.

Figure 2:
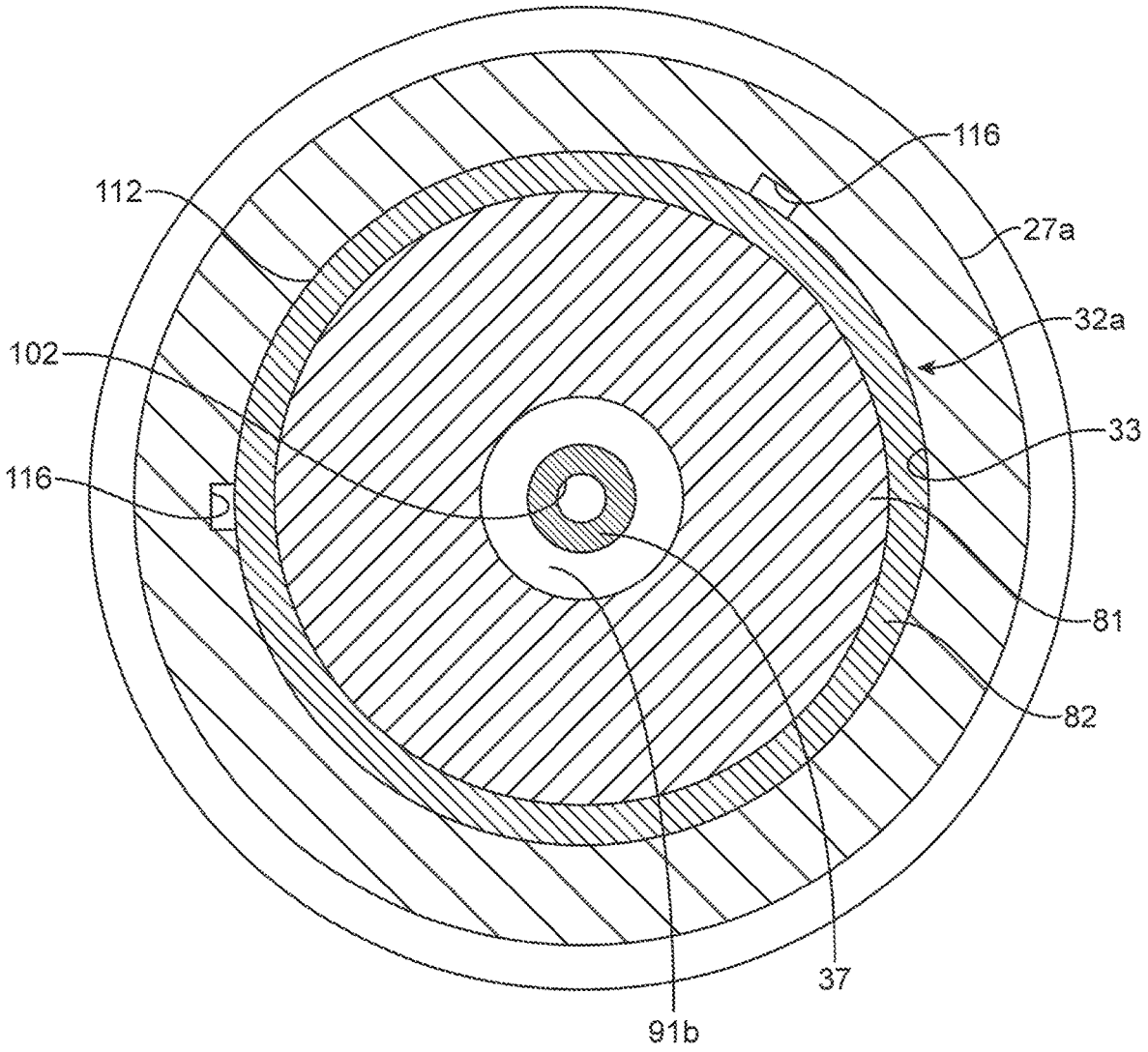
FIG. 2 is a cross-sectional view of the self-draining hydrant of FIG. 1 taken along the line 2-2 of FIG. 1.

Self-draining hydrant 21 can include an additional plurality of one or more slots or grooves for permitting water in upper reservoir 113 to drain to lower reservoir 107 when piston 32 is moved to its first or upper position, for example as shown in FIG. 1. The one or more slots or grooves can be similar to the one or more slots or grooves discussed above, for example the one or more slots or grooves 111. In some embodiments, the one or more slots or grooves for draining upper reservoir 113 can be referred to as ports or drains 116. In some embodiments, the one or more ports or drains 116 have a length, for example a vertical length, sufficient to extend across annular seal 82 when the central cylindrical portion 81 of the piston is in its first or upper position. In some embodiments, the bottoms of each of the one or more ports or drains 116 are vertically disposed on wall 112 so that when piston 32 is in its first position, the annular seal 82 around the periphery of the central cylindrical portion 81 of piston upper head 32*a* is in contact with the bottom of each of the ports or drains 116 so as to allow any residual water in upper reservoir 113 to bypass the seal 82 and drain to lower reservoir 107. FIG. 2 shows one or more drains or ports 116 making contact with annular seal 82 on central cylindrical portion 81 of piston upper head 32*a* so as to permit water in upper reservoir 113 to drain into lower reservoir 107.

The one or more ports or drains 116 can be provided in inner wall 112 forming chamber 33. In some embodiments, the one or more ports or drains 116 can be circumferentially spaced-apart around inner wall 112. In some embodiments, the one or more ports or drains 116 provide a sufficient remaining portion of the wall forming chamber 33 to inhibit radial drift of the piston upper head 32*a* with respect to longitudinal axis 28 when the piston 32 is in its first or upper position.

In FIG. 5A of some methods of operation, piston 32 is at the top of its stroke and annular seal 82 in the central cylindrical portion of the piston upper heads makes contact with each of the one or more ports or drains 116 permitting any residual water in the upper reservoir 113 to drain into the lower reservoir 107. At the same time, water within wet pipe or tube 52 is permitted to drain into the lower reservoir 107 from the opening at the bottom of passageway 91 extending through piston upper head 32*a*. In FIG. 5B, as piston 32 moves down, water from lower reservoir 107 is forced back up wet pipe 52 though the opening at the bottom of passageway 91. In FIG. 5C, when annular seal 86 around lower cylindrical portion 84 engages opening 36, annular seal 82 around central cylindrical portion 81 of the upper piston head 32*a* comes in contact with the one or more slots or grooves 111 preventing a hydraulic lock by allowing remaining water in the lower reservoir 107 to pass the annular seal 82 and enter upper or additional reservoir 113. As piston 32 completes its downward travel and reaches its second position, shown in FIG. 5D, annular seal 86 is fully sealed on the inner cylinder wall of inner tubular member 62, and the upper seal 96 on piston lower head 32*b* moves below the one or more port 72*s* in the inner tubular member allowing supply water to flow into annular portion 34*b*, through passageway 91 and out wet pipe 52.

In one aspect of the invention, a self-draining hydrant for use with a water supply is provided and includes an outlet, a supply line coupled to the outlet, a housing adapted for placement in the ground and for coupling to the water supply, the housing coupled to the supply line for selectively providing water from the water supply to the supply line, the housing having a reservoir for receiving drained water from the supply line and a piston movable in a direction of travel from a first position to a second position within the housing for engaging the drained water and expelling it from the reservoir, the piston having a seal for engaging the housing to provide a seal with respect to the drained water, the housing being provided with at least one slot extending in the direction of travel and engageable by the seal for permitting drained water to pass the seal.

The housing can have an internal wall defining at least a portion of the reservoir, the seal engaging the internal wall while traveling from its first position to its second position, the at least one slot provided in the internal wall. The internal wall can be a cylindrical wall. The at least one slot can be fully contained in the internal wall out of communication with the exterior of the housing. The internal wall can have a thickness and the at least one slot can have a thickness less than the thickness of the internal wall. The seal can have a thickness and the slot can have a length greater than the thickness of the seal. The self-draining hydrant can further include an additional reservoir formed in part by the piston for receiving the drained water that passes the at least one seal. The reservoir can be a sealed reservoir so that the movement of the piston towards the second position pressurizes the drained water within the reservoir. The self-draining hydrant can further include a handle coupled to the housing and movable between first and second positions for controlling water from the water supply to the supply line. The handle can be coupled to the piston so that movement of the handle from its first position to its second position moves the piston from its first position to its second position.

In one aspect of the invention, an improved hydrant is provided wherein water is supplied to a dispenser, having a manually controlled source responsive to axial movement of a piston between flow and non-flow positions, and includes a cylinder within which the piston is axially movable between said positions, the piston having sealing means engageable with a cylinder wall inner surface, and there being axially extending slots in said wall and adjacent to which the sealing means travels between said positions to control said flow through the slots.

The hydrant can be manually controlled by an above ground handle structure. A water reservoir can be provided directly below the piston, and from which water can flow via the reservoir to an outlet as the piston lowers relative to ground surface level. The slots can be fully contained in a cylinder inner wall out of communication with the cylinder exterior. The slots can have a thickness dimension less than the radial dimension of the cylinder wall. The water can pass by means of the slots from the reservoir to the upper side of the piston as the piston is displaced axially downwardly into the reservoir. An upper set of additional slots can be provided in the cylinder inner wall for permitting water to travel from the upper side of the piston to the reservoir when the piston has returned to a higher in the cylinder. The cylinder can be located below the ground surface level, as where frost exists in the ground.

I claim:

1. A self-draining hydrant for use with a water supply, comprising an outlet, a supply line coupled to the outlet, a housing adapted for placement in the ground and for coupling to the water supply, the housing coupled to the supply line for selectively providing water from the water supply to the supply line, the housing having an internal reservoir for receiving drained water from the supply line and a piston movable in an axial direction of travel from a first position within the housing to a second position within the housing for engaging the drained water and expelling it from the internal reservoir, the piston having an annular seal for engaging the housing to provide a seal about the piston with respect to the drained water, the housing being provided with at least one slot extending in the axial direction of travel and engageable by the seal for permitting drained water in the internal reservoir to pass the seal.

2. The self-draining hydrant of claim 1, wherein the housing has an internal wall defining at least a portion of the reservoir, the annular seal engaging the internal wall while the piston travels in the axial direction from its first position to its second position, the at least one slot being provided in the internal wall.

3. The self-draining hydrant of claim 2, wherein the internal wall is a cylindrical wall.

4. The self-draining hydrant of claim 2, wherein the at least one slot is fully contained in the internal wall out of communication with the exterior of the housing.

5. The self-draining hydrant of claim 4, wherein the internal wall has a thickness and the at least one slot has a thickness less than the thickness of the internal wall.

6. The self-draining hydrant of claim 1, wherein the annular seal has a thickness and the slot has a length greater than the thickness of the seal.

7. The self-draining hydrant of claim 1, further comprising an additional reservoir formed in part by the piston for receiving the drained water that passes the annular seal.

8. The self-draining hydrant of claim 1, wherein the reservoir is a sealed reservoir so that the movement of the piston towards the second position pressurizes the drained water within the reservoir.

9. The self-draining hydrant of claim 1, further comprising a handle coupled to the housing and movable between first and second positions for controlling water from the water supply to the supply line.

10. The self-draining hydrant of claim 9, wherein the handle is coupled to the piston so that movement of the handle from its first position to its second position moves the piston from its first position to its second position.

11. A self-draining hydrant for use with a water supply, comprising an outlet, a supply line coupled to the outlet, a housing adapted for placement in the ground and for coupling to the water supply, the housing coupled to the supply line for selectively providing water from the water supply to the supply line, the housing having a cylindrical wall defining at least a portion of a reservoir for receiving drained water from the supply line and a piston movable in a direction of travel from a first position to a second position within the cylindrical wall for engaging the drained water and expelling it from the reservoir, the piston having a seal for engaging the cylindrical wall while traveling from its first position to its second position to provide a seal with respect to the drained water, the cylindrical wall being provided with at least one slot extending in the direction of travel and engageable by the seal for permitting drained water to pass the seal, the cylindrical wall having a thickness and the at least one slot having a thickness less than the thickness of the cylindrical wall.

12. The self-draining hydrant of claim 11, further comprising an additional reservoir formed in part by the piston for receiving the drained water that passes the seal.

13. The self-draining hydrant of claim 11, wherein the reservoir is a sealed reservoir so that the movement of the piston towards the second position pressurizes the drained water within the reservoir.

14. The self-draining hydrant of claim 11, further comprising a handle coupled to the housing and movable between first and second positions for controlling water from the water supply to the supply line.

15. A self-draining hydrant for use with a water supply, comprising an outlet, a supply line coupled to the outlet, a housing adapted for placement in the ground and for coupling to the water supply, the housing coupled to the supply line for selectively providing water from the water supply to the supply line, the housing having an internal chamber formed by an internal cylindrical wall for receiving drained water from the supply line and a piston movable in an axial direction of travel from a first position to a second position within the chamber for engaging the drained water and expelling it from the chamber, the piston having a peripheral seal for engaging the internal cylindrical wall to provide a seal about the piston with respect to the drained water, the internal cylindrical wall being provided with at least one slot extending in the axial direction of travel and engageable by the seal for permitting drained water in the chamber to pass the seal.

16. The self-draining hydrant of claim 15, wherein the at least one slot is fully contained in the internal cylindrical wall out of communication with the exterior of the housing.

17. The self-draining hydrant of claim 15, further comprising a reservoir formed in part by the piston for receiving the drained water that passes the seal.

18. The self-draining hydrant of claim 15, wherein the internal chamber is a sealed chamber so that the movement of the piston towards the second position pressurizes the drained water within the chamber.

* * * * *